US006982400B1

(12) United States Patent
Nguon

(10) Patent No.: US 6,982,400 B1
(45) Date of Patent: Jan. 3, 2006

(54) ELECTRICAL HEATER APPARATUS

(75) Inventor: Bunratthanna Nguon, Providence, RI (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/980,532

(22) Filed: Nov. 3, 2004

(51) Int. Cl.
*H05B 3/10* (2006.01)

(52) U.S. Cl. ..... 219/548; 219/544

(58) Field of Classification Search ..... 219/548, 219/534, 541, 544, 546, 205
See application file for complete search history.

(56) References Cited

U.S. PATENT DOCUMENTS 4,236,065 A 11/1980 Yashin et al.
4,282,003 A * 8/1981 Yashin et al. ..... 29/619
4,395,623 A * 7/1983 Shimada et al. ..... 219/544
4,480,174 A * 10/1984 Hummel ..... 392/498
4,689,878 A * 9/1987 Beauregard et al. ..... 29/611
4,822,980 A * 4/1989 Carbone et al. ..... 392/453
5,601,742 A * 2/1997 Yamashita ..... 219/207
6,455,822 B1 * 9/2002 Chang ..... 219/540

* cited by examiner

*Primary Examiner*—Robin O. Evans
*Assistant Examiner*—Vinod Patel
(74) *Attorney, Agent, or Firm*—Russell E. Baumann; Frederick J. Telecky, Jr.

(57) ABSTRACT

A self retaining crankcase heater (10) has a tubular casing (12) of relatively flexible, thermally conductive material in which is received a PTC element (16), sandwiched by semi-cylindrical terminal blocks (14). Spring contacts (18*a*) are received in grooves (14*c*) of the terminal blocks and the assembly is potted with heat conductive material (20) and sealed with sealant (22). Locking projections (12*d*) are formed at open end (12*c*) of the casing which are lockingly received in an annular recess (24*a*; 26*d*) of a well (24; 26) in a compressor housing wall.

14 Claims, 6 Drawing Sheets

ELECTRICAL HEATER APPARATUS

FIELD OF THE INVENTION

This invention relates generally to electrical heaters and more particularly to electrical heaters for crankcase heaters used in compressor heat pump applications.

BACKGROUND OF THE INVENTION

Crankcase heaters are typically used in HVAC compressor applications. After prolonged off periods and before start up, refrigerant in compressors tend to mix with oil in the compressor forming a refrigerant/oil solution. A crankcase heater is used to drive out refrigerant from the refrigerant/oil solution in order to prevent damage to the compressor due to lack of lubrication and/or high solution volumes.

An effective crankcase heater which has become widely used is shown and described in U.S. Pat. No. 4,236,065. This heater device comprises a self-regulating positive temperature coefficient of resistivity (PTC) element potted inside a thermally conductive ceramic body, such as alumina or steatite. The ceramic body and PTC element are potted with grit (alumina powder and de-ionized water mixture) and then sealed with a sealant, such as RTV polymer, to seal the device from moisture. The ceramic body provides electrical isolation between the device and a metallic housing or well provided in the shell of a compressor which receives the heater device. Heat generated by the PTC element is conducted through the ceramic body and the metallic housing into the refrigerant/oil solution to boil off the refrigerant from the solution within the compressor. When heated, the PTC element increases in temperature to a preselected temperature based on the anomaly temperature or the Curie point of the PTC element.

However, due to tolerance stack-ups between the device and the inner well diameter, the ceramic body is required to be undersized so that it will fit into the metal well attached to the compressor housing. To augment heat transfer from the heater to the well, thermal joint compound such as thermal grease is used to fill the air pocket between the heater and the well. The inner diameter of the well determines the permissible outer diameter of the ceramic body which is to be fitted within the well. A heater device is installed by applying thermal grease on the device and in the well. The device is then inserted in the well and a retaining clip is inserted to secure the device in the well.

Although the above described heater device is reliable, long lasting and inexpensive, the installation procedure is more labor intensive and cumbersome than desired.

SUMMARY OF THE INVENTION

It is therefore an object of the invention to provide a reliable, long lasting and inexpensive heating device for crankcase heaters and the like which are more easily and inexpensively installed in a heater well of a compressor than prior art heaters.

Another object of the invention is the provision of an electric heater for use as a crankcase heater which does not require the use of thermal grease when installing the heater in the well of a compressor.

Yet another object of the invention is the provision of a crankcase heater which overcomes the limitations of the prior art noted above and provides a more cost effective solution.

Briefly, according to the invention, a heater assembly comprises first and second generally semi-cylindrical members or terminal blocks formed of suitable thermally conductive metallic material such as aluminum, which sandwich a PTC heating element closely received in an elongated tubular casing having closed and open opposite ends. The casing material is designed and controlled to tight tolerances to ensure proper fit and performance with no thermal interface material used for enhancement of heat transfer between the heater device and the well and is formed of relatively flexible, thermally conductive material such as silicone polymer. The terminal blocks are each formed with a groove formed in a surface of the terminal blocks facing the PTC element for receipt of a respective electrical spring contact. The terminal blocks are spaced from one another by means of opposing longitudinally extending ribs formed in the side wall of the casing. The longitudinal length of the terminal blocks is less than the longitudinal length of the casing thereby providing space for placement of an alumina-water (grit) compound. After grit curing, a sealant is applied to the top of the device to protect the internal components from moisture.

The casing is formed with a self retaining clip feature comprising opposed projections extending radially outwardly from the casing wall at the open end thereof. The projections are received in an annular recess formed either directly in the well or between the side wall of the well and the opening in the compressor shell which communicates with the well for locking retention in the well upon insertion of the heater device. Preferably, the projections are formed with an inclined wall on the bottom side to facilitate insertion of the heater device into the well and a generally radially extending surface on the top side to impede removal of the heater device from the well.

BRIEF DESCRIPTION OF THE DRAWINGS

Other objects and features of the invention will become apparent by reference to the following detailed description of preferred embodiments when considered in connection with the accompanying drawings wherein.

Corresponding reference characters indicate corresponding parts through the several views of the drawings.

DETAILED DESCRIPTION OF THE PREFERRED EMBODIMENT

Figure 1:
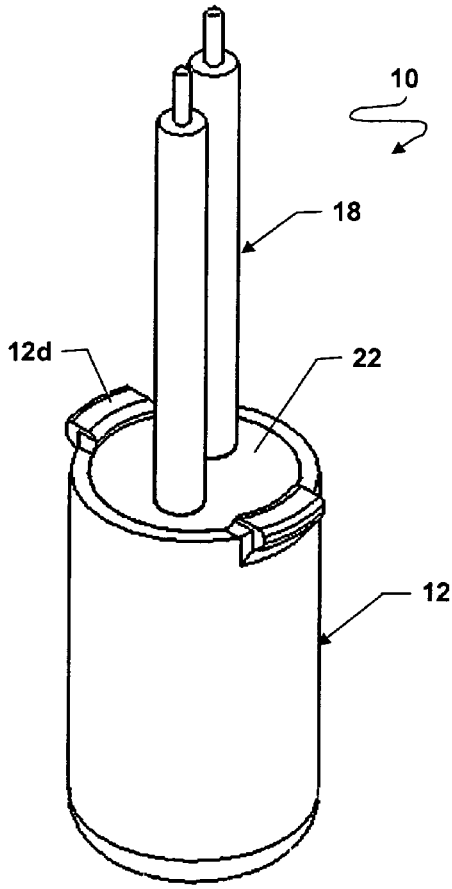
FIG. 1 is a perspective view of a heater device made in accordance with a preferred embodiment of the invention.
Figure 2:
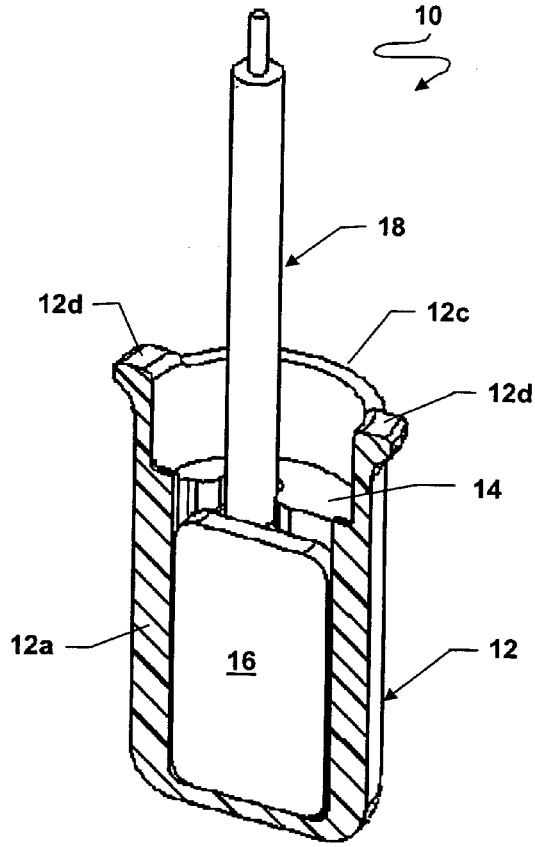
FIG. 2 is a longitudinal cross sectional view of the FIG. 1 device.
Figure 3:
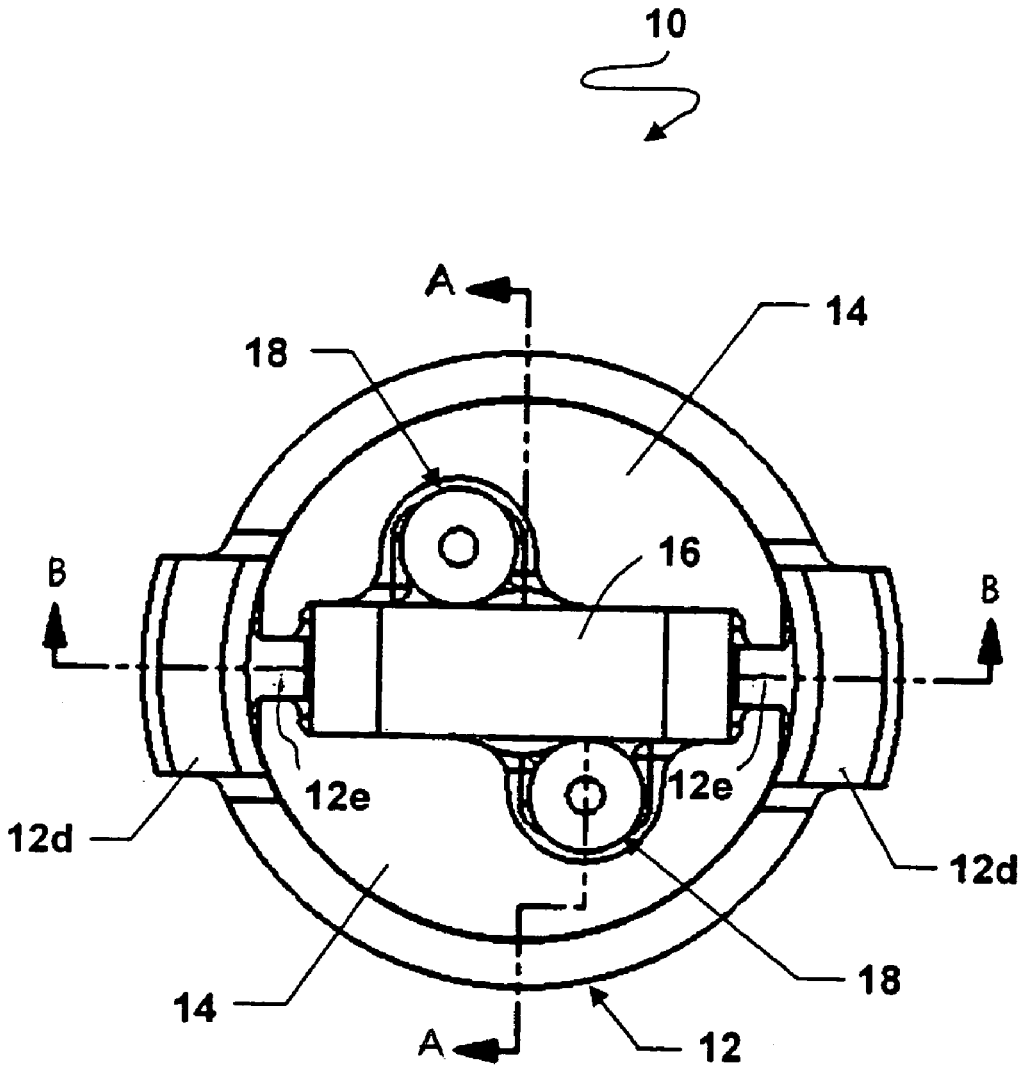
FIG. 3 is an enlarged top plan view of the FIG. 1 heater device.

With particular reference to FIGS. 1–6, numeral 10 indicates a heater device made in accordance with the preferred embodiment of the present invention. Heater device 10 comprises a tubular, generally cylindrical casing 12 formed of relatively flexible, electrically insulative and thermally conductive material such as silicone elastomer. Casing 12 has an elongated side wall 12*a*, a bottom end wall 12*b* and an open end 12*c*. Diametrically opposed retainer projections 12*d* are integrally formed at open end 12*c* and will be discussed below.

A heater assembly comprising first and second like terminal blocks 14 sandwiching an electrical resistance heating element 16 with electrical lead wires and spring contacts 18 are closely received in the casing in good thermal conductive relationship therewith.

Figure 6:
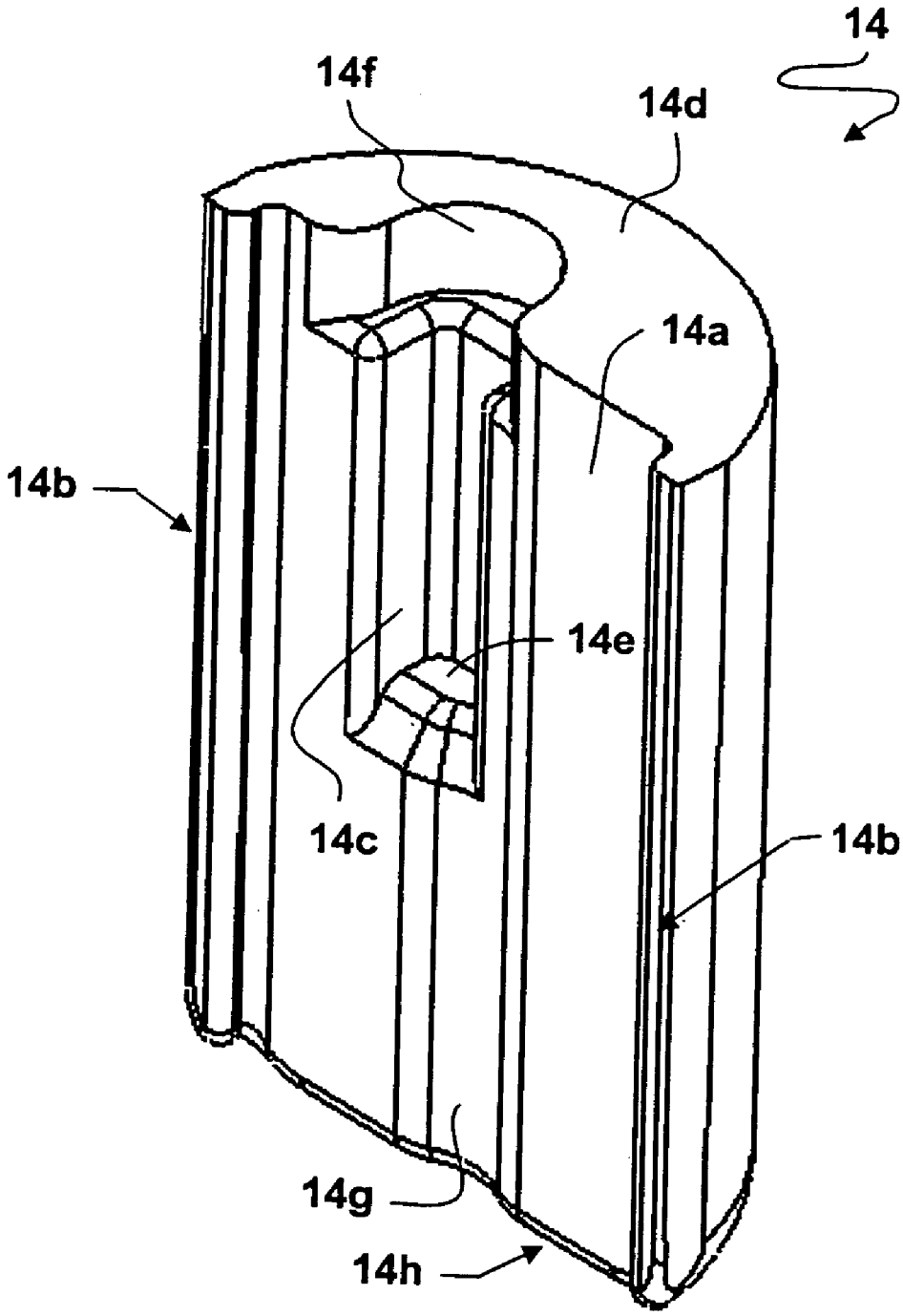
FIG. 6 is an enlarged perspective view of one of two like terminal blocks employed in the FIG. 1 heater device.

With particular reference to FIG. 6, each terminal block 14 is a generally semi-cylindrical solid of suitable heat conductive material, such as aluminum. The length of terminal blocks 14 is selected to be less than that of side wall 12*a* of casing 12 to leave a cavity for the purpose of placing potting and sealing material, to be discussed.

Preferably, and as shown, terminal blocks 14 are each formed with a shallow seating recess 14*a* extending the length of the block which serves to seat heater element 16. Casing 12 is formed with two opposing, longitudinally extending ribs 12*e* effectively dividing the chamber within the casing into two sections with each section receiving a respective terminal block. The semi-cylindrical side wall of the terminal blocks at the extremity of the curved peripheral portion is shortened at 14*b* essentially half the width of the ribs 12*e* so that the mating surfaces of the terminal blocks and the inside surface of side wall 12*b* will closely match, see FIG. 3.

A spring contact receiving groove 14*c* is formed in heater element seat 14*a* having an opening at end 14*d* of the terminal block and a closed end 14*e* intermediate to terminal block ends 14*d*, 14*h*. Preferably, an enlarged recess 14*f* in communication with groove 14*c* is also formed at end 14*d* to accommodate the end portion of the insulation sleeve on wire lead 18 to be received therein.

Another shallow groove 14*g* is preferably formed in seat 14*a* along the longitudinal axis of the semi-cylindrical terminal blocks along its entire length to facilitate the potting procedure. Potting of heater element 16 and terminal blocks 14 in casing 12 requires alumina-water (grit) compound 20 to be first deposited in casing 12 after which terminal blocks 14 are inserted in casing 12 along longitudinally extending ribs 12*e*, followed by insertion of the heater element 16 into casing 12 between the shallow recessed faces 14*a* of terminal blocks 14. The embodiment is then filled with grit to just cover the top surface of heater element 16. The shallow grooves 14*g* along the entire length of terminal blocks 14 allow for easy insertion of heater element 16 by permitting grit to flow upwards during insertion of heater element 16 and downwards during the filling operation to ensure total surface area coverage of heater element 16.

Figure 5:
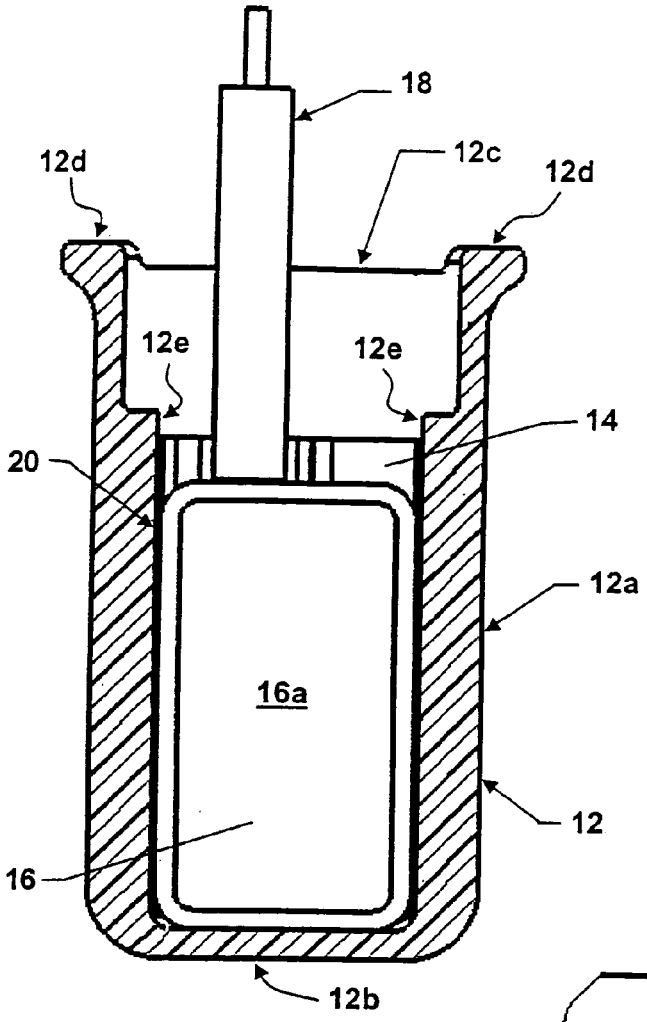
FIG. 5 is a cross sectional view taken on line B—B of FIG. 3.

Heater element 16 is preferably a self-regulating positive temperature coefficient of resistivity (PTC) element of the type disclosed in U.S. Pat. No. 4,236,065, referenced above, the disclosure of which is incorporated herein by this reference. PTC element 16 is preferably formed generally in the configuration of a parallelepiped and of a size to fit in close thermally conductive relation with seating surface 14*a* of the terminal blocks spaced apart by ribs 12*e*. A suitable electrically conductive coating 16*a* is applied to opposite face surfaces of the element in a known manner, one coating of which is shown in FIG. 5. The particular anomaly or Curie temperature of the PTC element is selected based on the particular application. For example, for certain compressor applications, a 120° C. Curie temperature element is used as in the referenced patent while in another compressor application a 160° C. Curie temperature element is employed.

Figure 4:
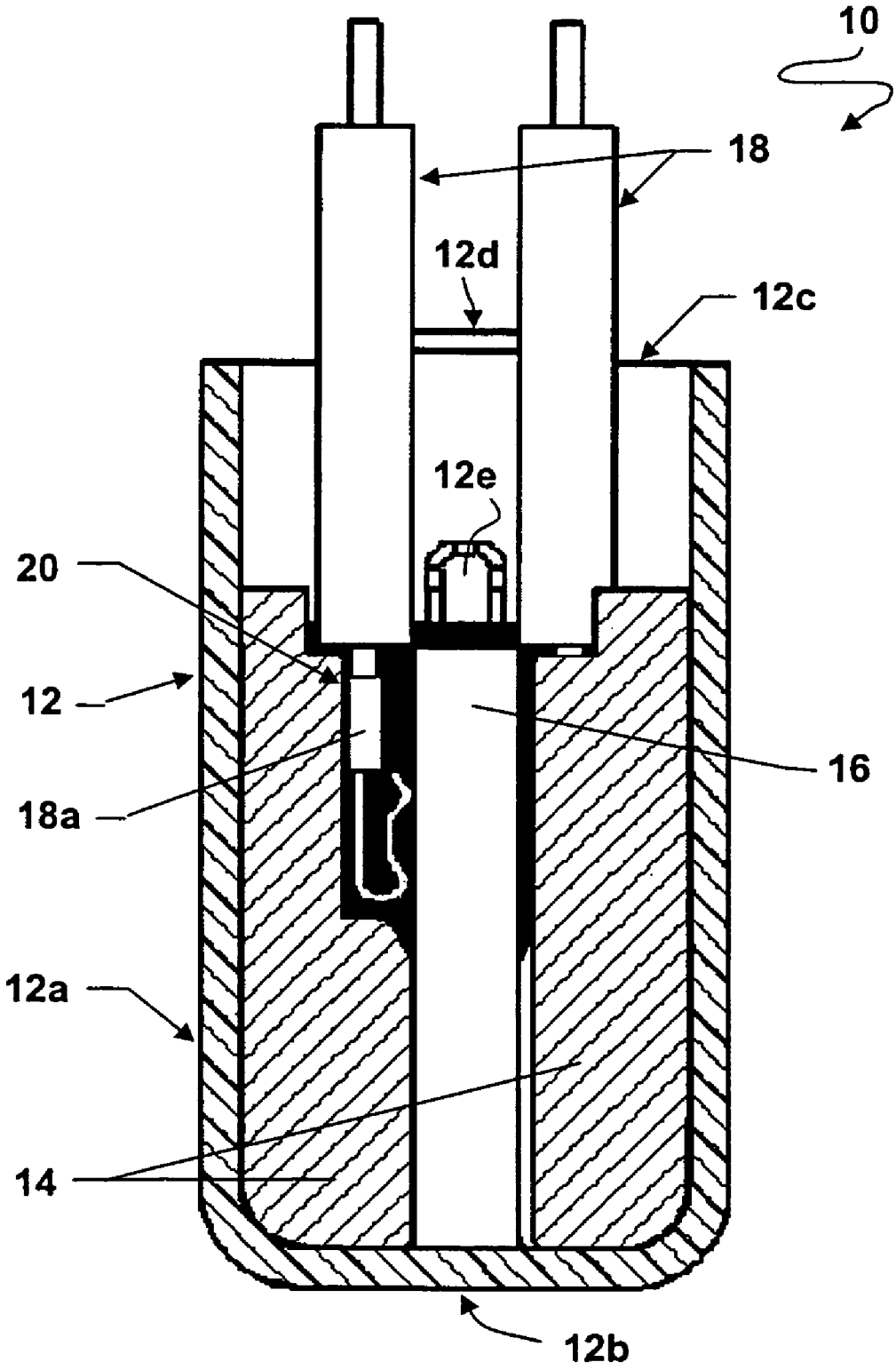
FIG. 4 is a cross sectional view taken on line A—A of FIG. 3.

As best seen in FIG. 4, first and second lead wires 18 having a respective spring contact 18*a* (one spring contact being shown) are inserted into respective grooves 14*c* of the terminal blocks with the spring contacts biased into electrical engagement with the facing conductive coatings of the PTC element.

In assembling the heater device, the terminal blocks, PTC element and lead attached spring contacts, i.e., the heater assembly, are inserted into the chamber of casing 12 and potted with an alumina-water (grit) compound 20 potting material. This assembly is then placed in a fixture and allowed to cure. After grit curing, the remaining space at the opening of the chamber is infilled with a suitable RTV polymer 22 to protect the heater assembly from moisture.

Figure 5A:
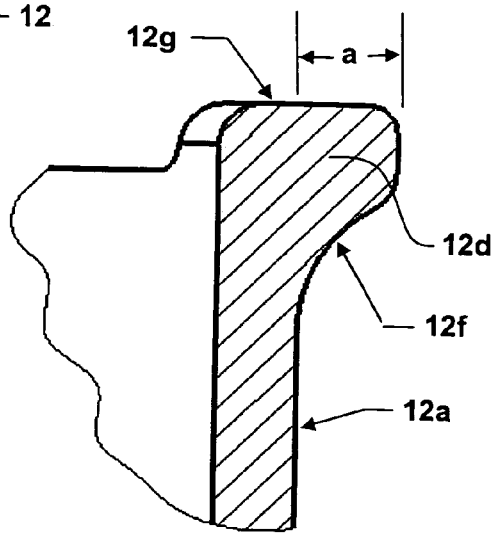
FIG. 5A is an enlarged broken away portion of FIG. 5.

As noted above, casing 12 is formed with opposed retainer projections 12*d* at open end 12*c*. The projections extend radially outwardly beyond side wall 12*a* of the casing a distance "a" (see FIG. 5A) selected so that the projections will extend into a recess formed in the well in which heater device 10 is to be disposed in use, as will be discussed further, below.

Preferably, the bottom surface 12*f* is inclined in an upward, outward direction to facilitate insertion of the casing through an opening to the well with a projection receiving recess portion formed adjacent to the opening and intermediate to the opening and a smooth tubular portion of the well which receives side wall 12*a* of casing 12. In effect, the projections are compressed and cammed inwardly as the projections of the casing are inserted past the opening and into the recessed portion. Surface 12*f* is shown in the drawings as a curved surface but it will be appreciated that at least a portion thereof could extend in a straight direction as well. Also, as shown in the drawings (see FIG. 5), projections 12*d* extend longitudinally beyond the remainder of the opening at end 12*c*. This enhances flexibility of the projections when inserting the projections through the opening into the well. Preferably, the top surface 12*g* of the retainer projections lie in a plane generally normal to the longitudinal axis of casing 12 or even slope upwardly in an outward direction from side wall 12*a* in order to lock casing 12 into the well.

Two projections 12*d* are shown in the drawings but it is within the purview of the invention to use a single annular projection or more than two projections, as desired.

Figure 7:
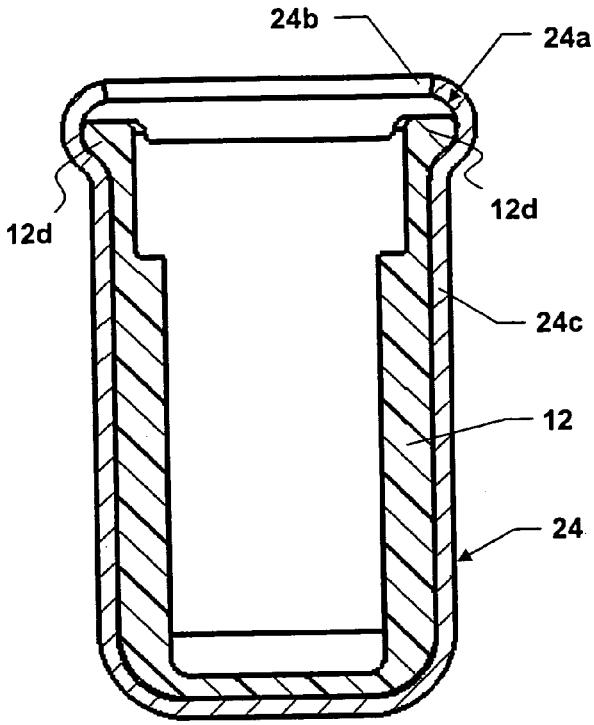
FIG. 7 is a longitudinal cross section of one type of well for receiving the heater device shown for the purpose of illustrating the retaining feature of the casing.
Figure 8:
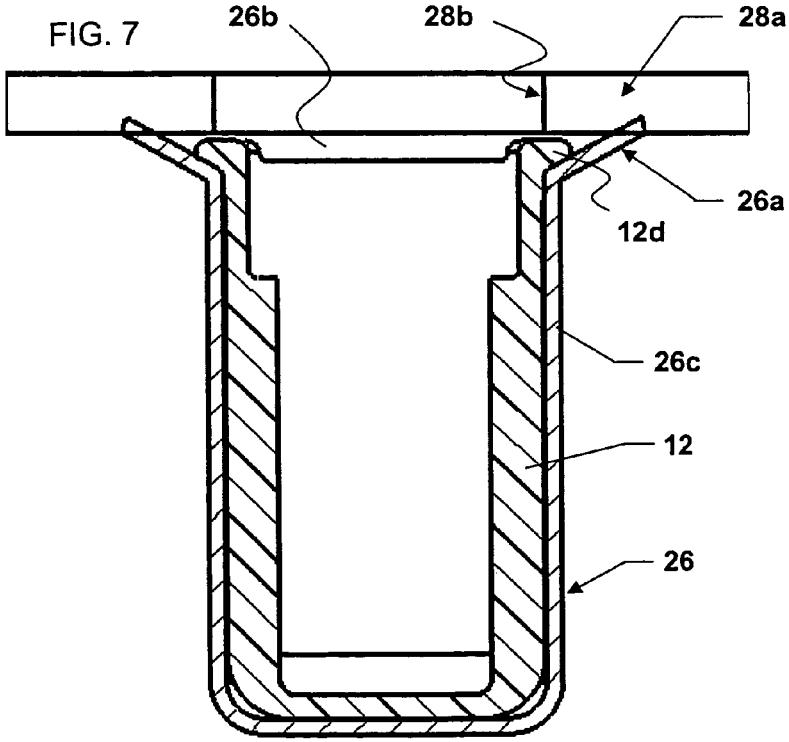
FIG. 8 is similar to FIG. 7 but shows another type of well for receiving the heater device.

FIGS. 7 and 8 show two examples of wells with which heater device 10 can be used. For purposes of illustration, only casing 12 of heater device 10 is shown to illustrate the locking action of projections 12*d*. In FIG. 7, well 24 formed of suitable material such as copper or steel has an annular recess 24*a* adjacent to opening 24*b* and a straight cylindrical side wall portion 24*c* which receives side wall 12*b* of the casing in close heat conductive relationship therewith. Well 24 is suitably attached to the compressor housing by resistance welding, brazing or the like. The heater device is inserted into the well with projections 12*d* being bent and compressed inwardly as they pass opening 24*b* during insertion and then are received in recess 24*a* when the heater device is fully seated.

In FIG. 8, well 26 has an outwardly flared flange portion 26*a* at its open end which is suitably attached to the compressor housing in alignment with opening 28*b* of compressor housing wall 28*a*. The diameter of opening 28*b* has a size generally corresponding to the inside diameter of side wall 26*c* which receives the side wall 12*a* of the casing. Thus, the space 26*d* between flange portion 26*a* and compressor housing 28*a* forms an annular projection receiving recess. Projections 12*d* are received in recess 26*d* by being bent and compressed as they pass opening 28*b* in the same manner as in the FIG. 7 well.

Thus, in accordance with the invention, installation of heater device 10 into a compressor housing well is accomplished in a one step operation in which the device is inserted into the well without thermal grease and without a disparate retaining clip.

In view of the above, it will be seen that the several objects of the invention are achieved and other advantageous objects attained.

Although the invention has been described with regard to a certain preferred embodiment thereof, variations and modifications will become apparent to those of ordinary skill in the art. It is therefore, the intention that the appended claims be interpreted as broadly as possible in view of the prior art to include all such variations and modifications.

What is claimed:

1. A heater device for use in a well formed in a housing, the well having an open end and a generally cylindrical side wall portion and a recess portion intermediate to the open end and the cylindrical side wall portion, the heater device comprising a generally cylindrical, tubular casing of thermally conductive, relatively flexible material having a side wall defining a chamber and having a first open end and a second closed end, at least two locking projections extending radially outwardly from the side wall of the casing at the first open end for receipt in the recess portion of the well, the casing having a longitudinal axis and at least two locking projections extending beyond the open end of the side wall in the longitudinal direction, each locking projection having a lower surface facing toward the closed end of the casing, the lower surface being inclined upwardly and outwardly from the casing sidewall, a heating assembly received in the chamber including:

an electrical resistance heater element having spaced apart first and second electrically conductive terminals, first and second heat conductive members sandwiching the heater element, the outer peripheral surface of the heat conductive members when sandwiching the heater element having an outer peripheral curved surface complimentary to the inside surface of the casing side wall and closely received in the chamber, wire leads electrically connected to the respective first and second terminals of the heater element and extending out of the open end of the casing, whereby the heater device upon being inserted into the well with the at least two locking projections received in the recess portion of the well is retained in the well by the locking projection.

2. A heater device according to claim 1 in which the casing is formed with two diametrically opposed locking projections.

3. A heater device according to claim 2 in which the locking projections have a lower surface facing toward the closed end of the casing, the lower surface being inclined upwardly and outwardly from the casing side wall.

4. A heater according to claim 3 in which the locking projections have an upper surface facing away from the closed end of the casing, the upper surface being generally flat and extending generally in a radial direction.

5. A heater device according to claim 1 in which the heater element is a positive temperature coefficient of resistivity element.

6. A heater device according to claim 1 in which the terminals of the heater element comprise electrically conductive layers and a groove is formed in each heat conductive member in a surface facing an electrically conductive layer on the heater element when sandwiching the heater element and a spring contact is attached to each wire lead, the spring contacts being disposed in respective grooves in engagement with a respective electrically conductive layer of the heater element.

7. A heater device according to claim 6 further comprising thermally conductive potting material received between the heater element, spring contacts and the heat conductive members.

8. A heater device according to claim 7 further comprising moisture resistant polymeric sealant material in the open end of the casing between the thermally conductive material and the open end of the casing side wall.

9. A heater device according to claim 1 in which the first and second heat conductive members are generally semi-cylindrical.

10. A heater device according to claim 9 in which the casing has a longitudinal axis and the side wall of the casing is formed with a pair of opposed longitudinally extending ribs forming separate seating areas and the heat conductive members are received in the respective seating areas separated from each other by the ribs.

11. A heater device according to claim 1 in which the lower surface is curved.

12. A heater device according to claim 1 in which the at least two locking projections have an upper surface facing away from the closed end of the casing, the upper surface being generally flat and extending generally in a radially direction.

13. A heater device according to claim 1 in which the casing is formed of a thermally conductive silicone polymer.

14. A heater device for use in a well formed in a housing, the well having an open end and a generally cylindrical side wall portion and a recess portion intermediate to the open end and the cylindrical side wall portion, the heater device comprising a generally cylindrical, tubular casing of thermally conductive, relatively flexible material having a side wall defining a chamber and having a first open end and a second closed end, two diametrically opposed locking projections extending radially outwardly from the side wall of the casing at the first open end for receipt in the recess portion of the well, the locking projections each having a lower surface facing toward the closed end of the casing, the lower surface being inclined upwardly and outwardly from the casing sidewall and an upper surface facing away from the closed end of the casing, the upper surface being generally flat and extending generally in a radial direction, and a heater assembly received in the chamber of the casing.

* * * * *